US006216667B1

(12) United States Patent
Pekar

(10) Patent No.: US 6,216,667 B1
(45) Date of Patent: Apr. 17, 2001

(54) METHOD AND DEVICE FOR A SUPERCHARGED ENGINE BRAKE

(76) Inventor: Frank J. Pekar, 6163 Alta Mira La., San Luis Obispo, CA (US) 93401-8254

( * ) Notice: Subject to any disclaimer, the term of this patent is extended or adjusted under 35 U.S.C. 154(b) by 0 days.

(21) Appl. No.: 09/438,318

(22) Filed: Nov. 12, 1999

(51) Int. Cl.[7] ..... F02D 9/06
(52) U.S. Cl. ..... 123/320
(58) Field of Search ..... 123/320, 316, 123/323

(56) References Cited

U.S. PATENT DOCUMENTS

| | | | | |
|---|---|---|---|---|
| 1,013,528 | * | 1/1912 | Broderick | 123/323 |
| 1,803,145 | | 4/1931 | Reineke . | |
| 2,995,890 | * | 8/1961 | Dolza | 123/320 |
| 3,958,900 | | 5/1976 | Ueno | 417/237 |
| 4,211,083 | | 7/1980 | Ueno | 60/626 |
| 4,494,506 | | 1/1985 | Hayama et al. | 123/348 |
| 4,512,154 | | 4/1985 | Ueno | 60/626 |
| 4,658,781 | * | 4/1987 | Guinea | 123/320 |
| 4,848,289 | | 7/1989 | Meneely | 123/182 |
| 4,930,471 | | 6/1990 | Korner et al. | 123/196 |
| 5,146,890 | | 9/1992 | Gobert et al. | 123/321 |
| 5,315,974 | | 5/1994 | Sabelstrom et al. | 123/320 |
| 5,347,968 | | 9/1994 | Johnson, Jr. | 123/320 |
| 5,609,134 | | 3/1997 | Schmidt et al. | 123/322 |
| 5,636,611 | | 6/1997 | Frankle et al. | 123/322 |
| 5,724,939 | | 3/1998 | Faletti et al. | 123/322 |
| 5,970,944 | * | 10/1999 | Kawamura | 123/316 |
| 6,050,239 | * | 4/2000 | Frankle et al. | 123/320 |

FOREIGN PATENT DOCUMENTS

| | | | | |
|---|---|---|---|---|
| 54-16010 | * | 2/1979 | (JP) | 123/316 |

* cited by examiner

*Primary Examiner*—Erick Solis
(74) *Attorney, Agent, or Firm*—Liniak, Berenato, Longacre & White, LLC

(57) ABSTRACT

The invention relates to a system and method for engine braking a four-stroke internal combustion engine. The engine has for each cylinder at least one inlet valve and at least one exhaust valve for controlling communication between a combustion chamber in the cylinder and an inlet system and an exhaust system, respectively. In addition, each cylinder communicates with an independent high pressure transfer passage via individual transfer valves disposed at each cylinder. The transfer valves, respectively, put each cylinder at the early part of its compression stroke in communication with the high pressure transfer passage that has been filled with high pressure air by another cylinder at the later part of its compression stroke. Opening the exhaust valve to further decompress the cylinder nearing the end of its compression stroke preferably follows this process. To achieve maximum retarding effect, the exhaust valve is only kept open long enough into the expansion stroke to decompress the cylinder and then the exhaust valve is closed so that expansion work takes place in the remaining part of the expansion stroke.

20 Claims, 4 Drawing Sheets

METHOD AND DEVICE FOR A SUPERCHARGED ENGINE BRAKE

BACKGROUND OF THE INVENTION a) Field of the Invention

The present invention relates generally to engine retarders and, more particularly, to a system and method for supercharging or precharging an engine brake mounted to a diesel engine.

b) Description of Related Art

The engine of a vehicle is often used as an auxiliary brake to retard vehicle speed. This particularly applies to heavy vehicles, such as trucks and buses, whose developments over recent years have resulted in engines of much greater power with unchanged cylinder volume. As a result, the average speed at which such vehicles are driven uphill has increased considerably, creating a need for greater braking power when driving downhill. In an exhaust brake, some form of throttle valve is incorporated in the exhaust system to achieve improved retarding power. This power, however, is relatively low and often less than half the driving power of the engine. In an engine brake, on the other hand, the exhaust valves are hydraulically opened near top dead center of the compression, thus absorbing power.

Furthermore, the resistance of such heavy vehicles to driving has decreased over recent years, meaning that the wheel or service brakes of the vehicles are subjected to greater loads. When driving in hilly terrain, the wheel brakes should be used as little as possible, primarily for safety reasons. The average speed of the vehicle in hilly terrain is therefore greatly influenced by the available engine retarding power, which increases the requirement for a more effective retarding that will also be capable of reducing wear and tear on the wheel brakes and thereby improve running economy.

When free-running, a four-stroke diesel engine, i.e. when the wheels of the vehicle drive the engine, a certain braking effect occurs as a result of the internal resistance in the engine, i.e., due to friction. This braking effect is relatively small, however, and has been further reduced in modern engines.

A well known method of improving the engine retarding power is to mount a throttle device, for instance a butterfly valve, in the exhaust system. When the valve is closed, an overpressure is generated in the exhaust system which causes the work to increase during the exhaust stroke, with a commensurate increase in retarding power. In this manner, retarding power can be increased by placing the combustion chamber in the cylinder in communication with the exhaust system during the latter part of the exhaust stroke and during a smaller or greater part of the intake stroke.

Alternatively, with an engine brake, the cylinder is placed into communication with the exhaust system at the end of the compression stroke and somewhat during the expansion stroke. This can be achieved, either by opening the conventional exhaust valve or with the aid of a separate valve. As a result, air compressed in the combustion chamber during the compression stroke will flow partially into the exhaust system, meaning that a large part of the compression work carried out during the compression stroke is not recovered during the expansion stroke, therewith increasing the retarding power. One known arrangement for carrying out this method utilizes the conventional exhaust valve. The exhaust valve operating cam is provided with an additional cam lobe which is operative to achieve the additional opening of the exhaust valve. The extent to which the exhaust valve is lifted by this additional lobe is relatively slight, and when the engine is used as a power source the valve clearance is sufficiently large to render the additional lobe inoperative. When braking vehicle speed with the aid of the engine, a hydraulic valve-clearance adjuster is brought into operation, such as to reduce the valve clearance, therewith bringing the additional lobe into operation The extent to which the exhaust valve is lifted during the conventional valve-opening sequence will at the same time be correspondingly greater, however, and this must be taken into account so that problems will not occur by impact of the exhaust valve against the piston.

It has been known that increasing boost pressure of the intake manifold increases retarding power with an engine compression release brake. Engaging a mechanical supercharger when retarding is a costly and complicated means to achieve increased boost. Likewise, adopting a supercharger with a variable area turbine is another costly and complicated means to achieve more boost.

When an exhaust brake is used in conjunction with an engine brake, some of the high pressure in the exhaust manifold may be tansferred under appropriate conditions to the cylinder to provide boost pressure. However, this type of combination brake creates increased exhaust manifold pressure by restricting the airflow through the engine, resulting in increased temperature in the exhaust valve, piston and nozzle components. The increase in critical component temperature and the corresponding increase in boost pressure must be limited to avoid injector nozzle needle seat and exhaust valve seat softening and wear.

The need therefore exists for an improved system and method to provide engine braking without suffering from the foregoing drawbacks.

SUMMARY OF THE INVENTION

The object of the present invention is to provide a method which will further improve engine braking power, and to provide a structural arrangement for carrying out the method without suffering from the drawbacks inherent in the prior art.

The present invention minimizes the high cost increase and/or durability disadvantages of conventional engine braking methods with a new method that provides even higher safe boost pressures with greater retarding horsepower.

The advantages of the present invention are primarily afforded by an engine brake system and method that puts a cylinder at the early part of its compression stroke in communication with an independent transfer passage filled with high pressure air generated by another cylinder at the later part of its compression stroke. The independent transfer passage communicates with each cylinder via a separate transfer valve disposed at each cylinder.

This process transfers high pressure air from a cylinder at the later part of its compression stroke to one at the earlier part of its compression stroke and is followed by opening the exhaust valve to further decompress the cylinder nearing the end of its compression stroke. To achieve maximum retarding effect, the exhaust valve is only kept open long enough into the expansion stroke to decompress the cylinder, and then the exhaust valve is closed so that expansion work takes place in the remaining part of the expansion stroke. The exhaust valve can, of course, be left open during the entire expansion stroke with some reduction of retarding effort. The process of this invention has little affect on the airflow through the engine since the normal intake and exhaust strokes are left undisturbed, thereby preventing overheating of critical engine components.

With the present invention, the pressure in the braking cylinder is increased and internal pre-charging is obtained. Communication between the cylinder and the exhaust system is also reestablished during the latter part of the compression stroke. Thus, air will flow out of the cylinder and the pressure therein will consequently be lowered, so that the following expansion stroke will produce insignificant or even negative expansion work. The undesirable volume-changing work is decreased during the intake stroke by closing communication between the exhaust system and the cylinder as soon as possible after the piston has passed its top-dead-center position.

BRIEF DESCRIPTION OF THE DRAWINGS

The invention will now be described in more detail with reference to the accompanying drawings, in which.

DETAILED DESCRIPTION OF PREFERRED EMBODIMENT

Figure 1:
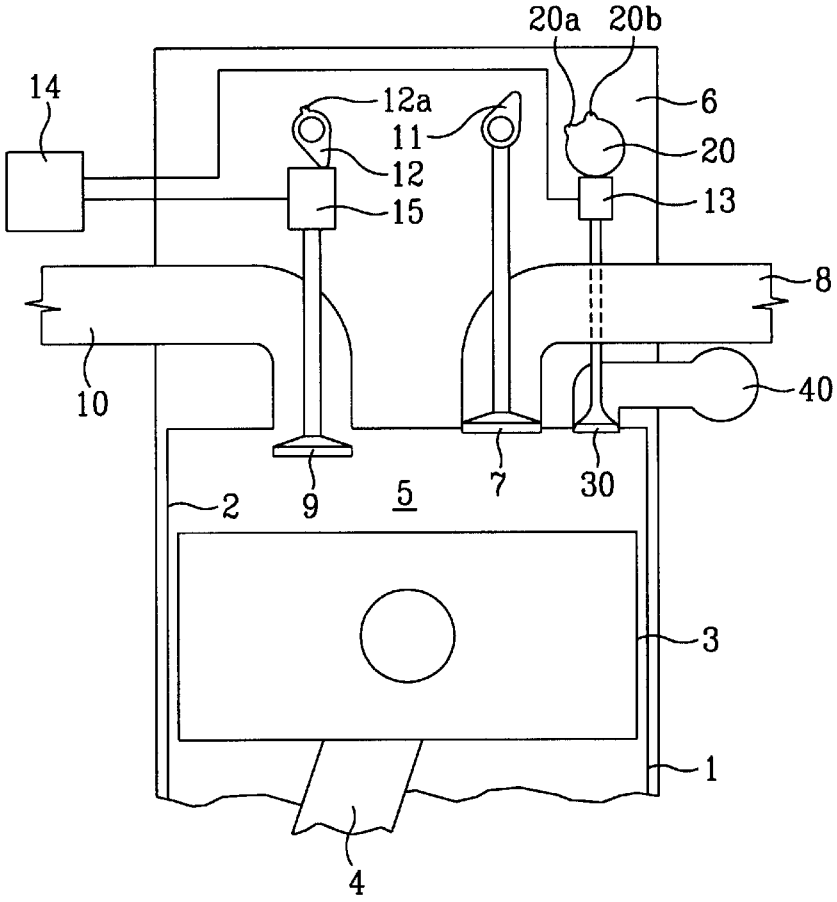
FIG. 1 is a schematic, fragmented, sectional view of a cylinder forming part of an engine provided with one embodiment of the present invention.

FIG. 1 is a schematic illustration of a four-stroke diesel engine which is intended for carrying out the inventive method and which to this end is provided with an arrangement according to a first embodiment of the invention. The engine illustrated in FIG. 1 includes an engine block 1 having a cylinder 2 which accommodates a piston 3 which is connected to a crankshaft (not shown) by means of a connecting rod 4. Located above the piston 3 in the cylinder 2 is a combustion chamber 5 which is closed by means of a cylinder head 6. Mounted in the cylinder head 6 is an intake valve 7 which controls the connection between the combustion chamber 5 and an intake system 8, of which only a part is shown. The cylinder head 6 also accommodates an exhaust valve 9, which controls communication between the combustion chamber 5 and an exhaust system 10, of which only a part is shown. The movement of the intake valve 7 and the exhaust valve 9 is controlled by camshafts provided with cams 11 and 12, respectively. Remaining parts of the engine are of minor significance to the invention and are therefore not described in detail here.

Figure 2:
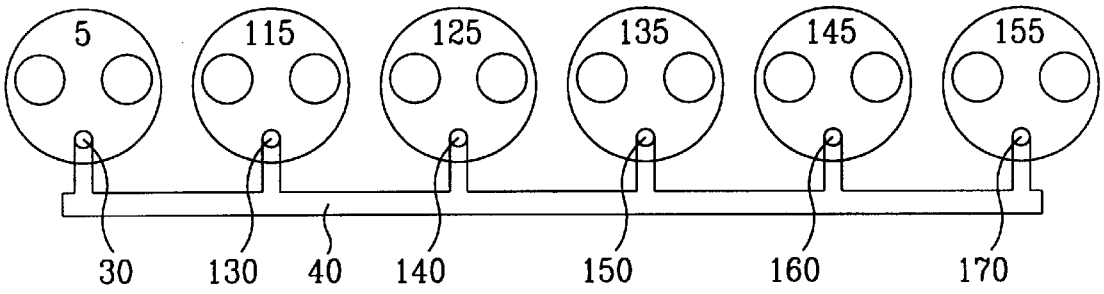
FIG. 2 is a schematic view illustrating how the cylinders are connected to the high pressure transfer passage.

In accordance with the structure and operation of the present invention, each combustion chamber 5, 115, 125, 135, 145, 155 is connected to a high pressure transfer passage 40 via a transfer valve 30, 130, 140, 150, 160, 170, respectively. The structural relationship and communication of each combustion chamber with the high pressure transfer passage 40 is schematically shown by FIG. 2. The transfer passage 40 is a delivery system that operates independently of the intake and exhaust systems in that delivery of high pressure air to and from the transfer passage is controlled by the transfer valves 30, 130, 140, 150, 160, 170. The transfer passage 40 itself is an independent tube or closed passageway selectively accessed by the transfer valves. For example, the transfer passage 40 may comprise a manifold exterior to the cylinder head, it may comprise a bore in the cylinder hear itself, and it may take any other form suitable to achieve the goals of this invention as appreciated by those of skill in the art. The material and structure of the transfer passage are selected to withstand the temperature, pressure and environmental conditions associated with a diesel engine.

Referring to FIGS. 1 and 2, the process of supercharging the combustion chamber 5 and cylinder 2 is accomplished by opening the transfer valve 30 by lobe 20A of cam 20 near the start of the compression stroke. At that time, high pressure air is admitted into the combustion chamber 5 from the transfer passage 40; that high pressure air being previously communicated into the transfer passage 2 from another cylinder in the latter part of its compression stroke. Transfer valve 40 is then closed by lobe 20A of cam 20 before mid-stroke, so that compression within compression chamber 5 can take place. Transfer valve 30 is then reopened in the latter part of its compression stroke by lobe 20B of cam 20, so that transfer passage 40 can be refilled with high pressure air to supercharge the next cylinder (i.e., one of combustion chambers 115, 125, 135, 145, 155) at the start of its compression stroke.

As transfer valve 30 is being closed by lobe 20B, exhaust valve 9 is being opened by lobe 12A of cam 12 to put the combustion chamber 5 in communication with the exhaust manifold, i.e., exhaust system 10. Exhaust valve 9 can be left open during the expansion stroke, or the valve 9 may be closed early in the expansion stroke to increase expansion work.

The exhaust system 10 of the engine illustrated in FIG. 1 also includes a throttle member. The throttle member is controlled by a regulating or control means 14, which controls a changing device or lash eliminating mechanisms 13, 15 which, when activated, change the engagement conditions between the cams 11, 12. The cams 11, 12 control the positions of the intake valve 7 and the exhaust valve 9. In the first embodiment of FIG. 1, this lash eliminating mechanism 15 comprises a hydraulic element that can be adjusted or switched between two mutually different lengths. Naturally, the length of the valve-mechanism can also be changed in some other way, for instance mechanically.

Figures 3A, 3B, 3C:
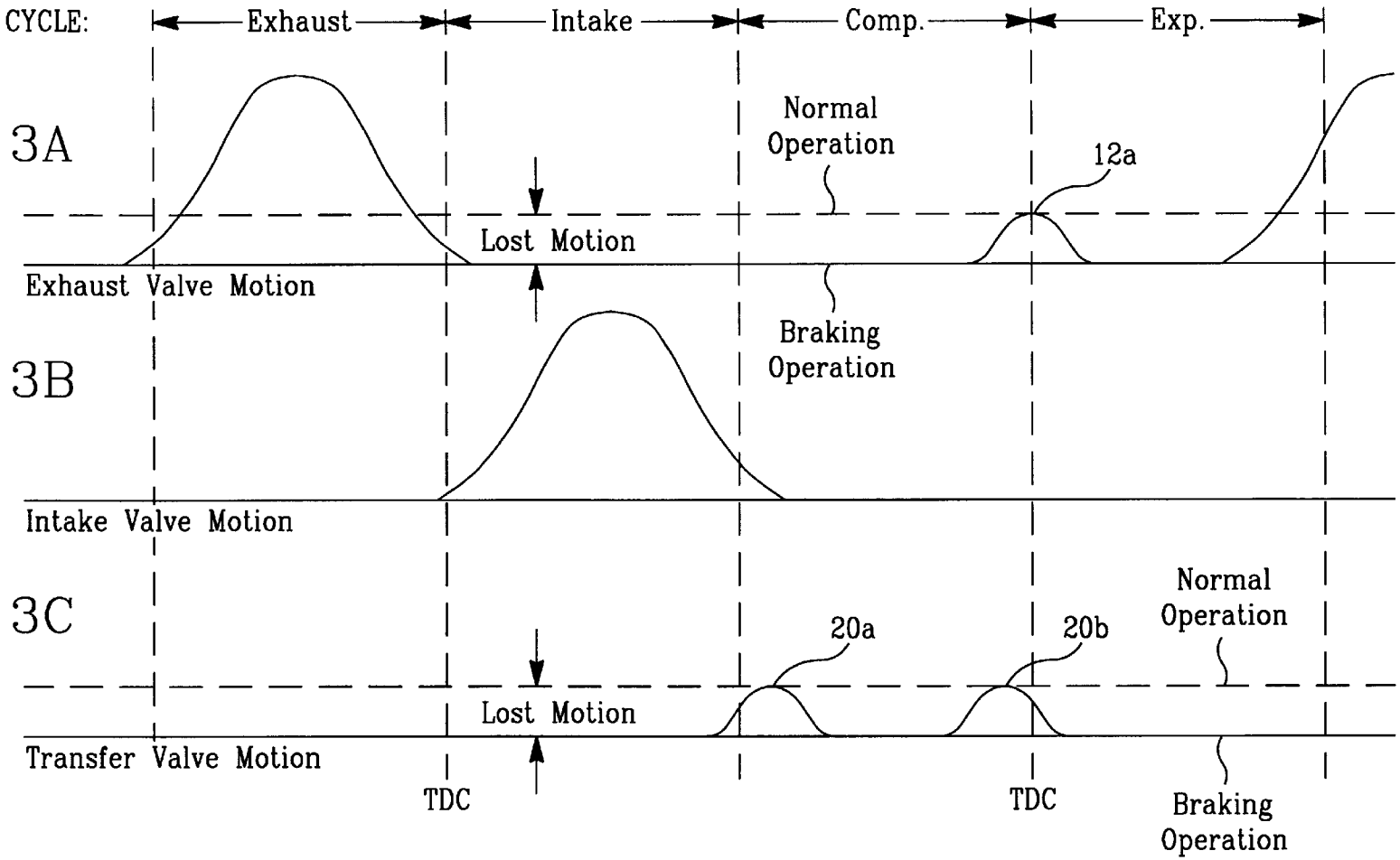
FIGS. 3*a*–3*c* are diagrammatic views illustrating how and when how the valves are lifted according to the operation of the embodiment of FIG. 1.

To actuate engine braking, the lash eliminating mechanisms 13, 15 are engaged by control means 14, thereby eliminating the lost motion between the transfer valve cam 20 and the transfer valve 30, and the exhaust cam 12 and the exhaust valve 9; respectively. The lost motion for both the exhaust and transfer valve mechanisms is shown in FIGS. 3*a*–3*c*. FIGS. 3*a*–3*c* are diagrammatic views illustrating how and when the valves are lifted according to the operation of the embodiment of FIG. 1. FIG. 3*a* illustrates the motion of the exhaust valve 9 through the four cycles of the four-stroke engine. FIG. 3*b* illustrates the motion of the intake valve through the four cycles of the four-stroke engine. FIG. 3*c* illustrates the motion of the transfer valve through the four cycles of the four-stroke engine. The cam 20 with lobes 20A and 20B and the lash eliminating mechanism 13 are only shown as one means to control the timing and lift of the transfer valve 30. Any other known means that can control timing and lift of transfer valve 30 as prescribed by this invention may be employed.

In a similar manner, other known means and mechanisms could be employed to accomplish lifting of the exhaust valve as prescribed by the timing and lift of cam 12. Moreover, the number and disposition of the intake and exhaust valve should not be limited in any manner by this description; rather, the number and specific arrangement of the intake and exhaust valves for each piston is limited only by the knowledge of the skilled artisan.

Figure 4:
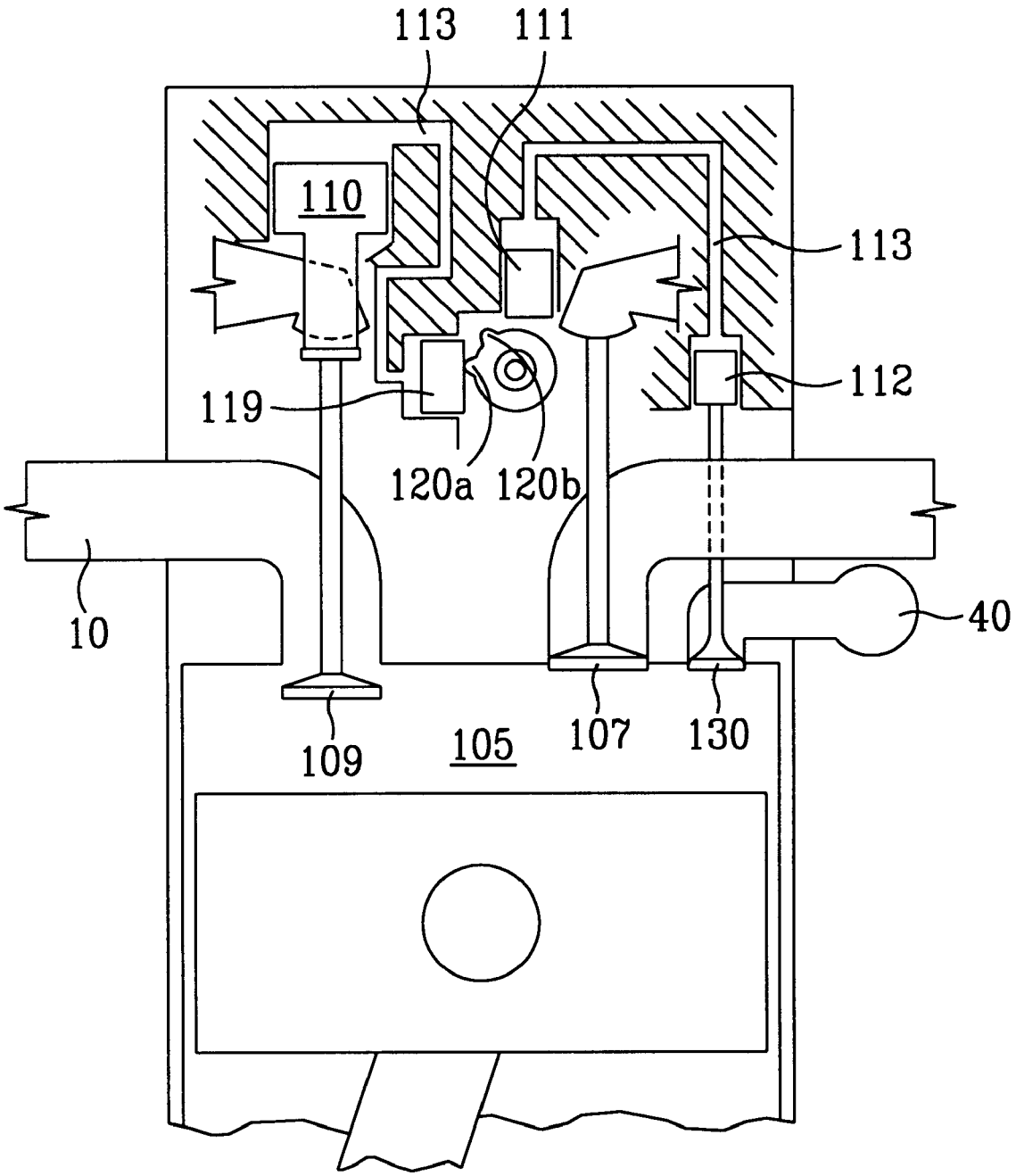
FIG. 4 is a schematic, fragmented, sectional view of a cylinder forming part of an internal combustion engine provided with a second embodiment of the present invention.

FIG. 4 illustrates a second embodiment of the present invention, wherein the transfer valve 130 and the exhaust valve 109 are controlled by a single cam system comprising a pair of cam lobes 120A, 120B acting on exhaust valve piston 119 and transfer valve piston 111.

To accomplish engine braking according to the second embodiment, passageways 113 are filled with oil so that piston 119 is hydraulically connected to piston 110, and piston 111 is hydraulically connected to piston 112. The means to fill and dump passageways 113 is not shown but such systems are known in the hydraulic engine brake art.

Referring to FIG. 4, the process of supercharging the compression chamber 105 is accomplished by lobe 120A pushing on piston 111 which hydraulically moves piston 112, thereby lifting transfer valve 130 near the start of the compression stroke. At that time, high-pressure air is admitted into the compression chamber 105 from the high-pressure transfer passage 40. Transfer valve 130 is then closed by lobe 120A before mid-stroke so that compression can take place. Transfer valve 130 is then reopened in the latter part of the compression stroke by lobe 120B so that passage 40 can be refilled with high-pressure air to supercharge the next cylinder at the start of its compression stroke. As transfer valve 130 is being closed by lobe 120B, exhaust valve 109 is being opened by lobe 120A pushing on piston 119 which hydraulically moves piston 110, thereby lifting exhaust valve 109.

Piston 119 is positioned approximately 90 degrees offset from the piston 111 thus resulting in exhaust valve motion approximately 180 degrees after transfer valve motion. Exhaust valve lift by lobe 120A puts the compression chamber 105 is communication with the exhaust manifold and closes the exhaust valve early in the expansion stroke. Exhaust valve 109 is reopened later in the expansion stroke by lobe 120B resulting in exhaust valve lift by lobe 120B. Lifting of exhaust valve 109 by lobe 120B is of little consequence since lifting of the exhaust valve by the exhaust cam takes place only a few degrees later.

Figures 5A, 5B, 5C:
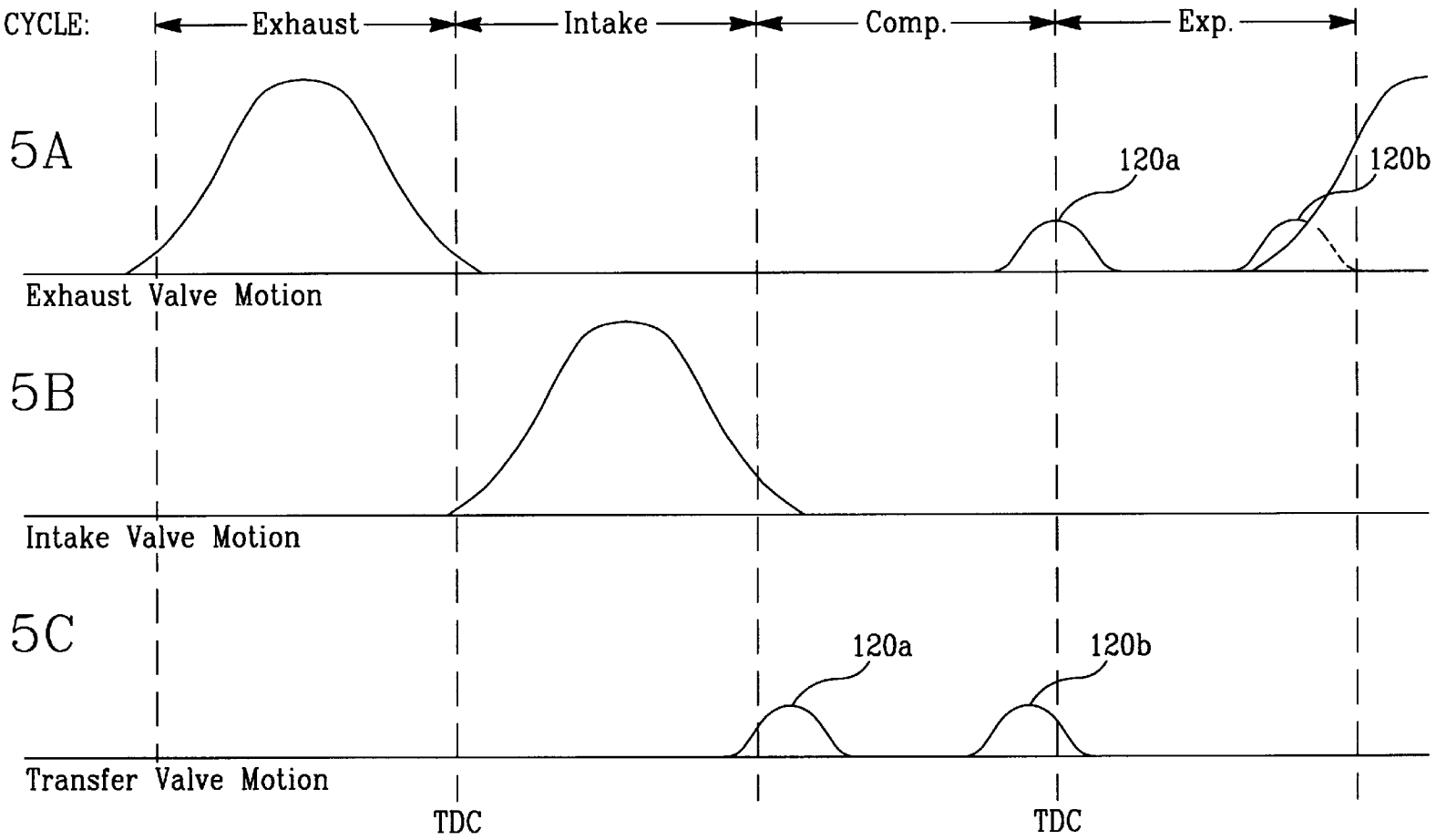
FIGS. 5*a*–5*c* are diagrammatic view illustrating how the valves are lifted according to the operation of the embodiment of FIG. 4.

The diagrams in FIGS. 5*a*–5*c* are diagrammatic views illustrating how and when the valves are lifted according to the second embodiment of FIG. 4. FIG. 5*a* illustrates the motion of the exhaust valve through the four cycles of the four-stroke engine. FIG. 5*b* shows the motion of the intake valve through the four cycles of the four-stroke engine. FIG. 5*c* shows the motion of the transfer valve through the four cycles of the four-stroke engine.

From the foregoing description, it is clear that the present invention provides an engine brake system and method that puts a cylinder at the early part of its compression stroke in communication with an independent transfer passage filled with high pressure air generated by another cylinder at the later part of its compression stroke. The independent transfer passage communicates with each cylinder via a separate transfer valve disposed at each cylinder. To achieve maximum retarding effect, the exhaust valve is only kept open long enough into the expansion stroke to decompress the cylinder, and then the exhaust valve is closed so that expansion work takes place in the remaining part of the expansion stroke. The exhaust valve can, of course, be left open during the entire expansion stroke with some reduction of retarding effort. The independent transfer valves and transfer passage of this invention have little affect on the air flow through the engine, because the normal intake and exhaust strokes are left undisturbed, thereby preventing overheating of critical engine components.

With the present invention, the pressure in the cylinder is increased and internal charging is obtained. Communication between the cylinder and the exhaust system is also reestablished during the latter part of the compression stroke. Thus, gas will flow out of the cylinder and the pressure therein will consequently be lowered, so that the following expansion stroke will produce insignificant or even negative expansion work The undesirable volume-changing work is decreased during the inlet stroke by closing communication between the exhaust system and the cylinder as soon as possible after the piston has passed its top-dead-center position.

While the invention has been shown and described with reference to several preferred embodiments, it will be understood by those of skill in the art that various changes in form and detail may be made therein without departing from the spirit and scope of the instant invention.

What is claimed is:

1. An engine braking system for a multi-cylinder four-stroke internal combustion engine having exhaust valves communicating a plurality of piston combustion chambers with an exhaust manifold, said engine braking system comprising:

a transfer passage for delivering an amount of pressurized gas from one of said piston combustion chambers to another of said piston combustion chambers independent of said exhaust manifold; and at least one transfer valve placing each of said combustion chambers in communication with said transfer passage.

2. The engine braking system of claim 1, wherein a first actuator opens a first transfer valve near an end of a first compression stroke of a first piston, whereby high pressure air is delivered from a first combustion chamber into said transfer passage.

3. The engine braking system of claim 2, wherein a second actuator opens a second transfer valve near a start of a second compression stroke of a second piston, whereby said high pressure air is admitted into a second combustion chamber of said second piston from said transfer passage.

4. The engine braking system of claim 3, wherein said second actuator closes said second transfer valve after said start of said second compression stroke thereby enhancing compression within said second compression chamber.

5. The engine braking system of claim 4, wherein said second actuator reopens said second transfer valve near an end of said second compression stroke thereby recharging said transfer passage with high pressure air.

6. The engine braking system of claim 1, wherein said transfer passage is isolated from said exhaust manifold.

7. The engine braking system of claim 1, further comprising control means for controlling operation of said transfer valve.

8. The engine braking system of claim 7, wherein said control means operates independently of said intake and exhaust valves.

9. The engine braking system of claim 7, wherein said control means comprises a first cam member actuating an exhaust valve and a second cam member actuating said transfer valve.

10. The engine braking system of claim 9, wherein said second cam member comprises a pair of cam lobes actuating said transfer valve at two independent time intervals.

11. The engine braking system of claim 7, wherein said control means comprises a single cam member actuating both an exhaust valve and said transfer valve.

12. The engine braking system of claim 11, wherein said single cam member actuates each of said exhaust valve and said transfer valve through a hydraulic piston and fluid system.

13. The engine braking system of claim 11, wherein said single cam member comprises a pair of lobes actuating each of said exhaust valve and said transfer valve at two independent time intervals.

14. The engine braking system of claim 1, further comprising a lash eliminating mechanism for eliminating lost motion between a transfer valve cam and said transfer valve, and for eliminating lost motion between an exhaust cam and said exhaust valve.

15. The engine braking system of claim 9, wherein said transfer valve cam is provided with at least two lobes actuating said transfer valve at two independent time intervals.

16. A method for engine braking with a four-stroke engine, said engine having for each cylinder at least one intake valve and at least one exhaust valve for controlling communication between a combustion chamber in each cylinder and an intake system and an exhaust system respectively, comprising the steps of:

opening a first communication between a first combustion chamber and a transfer passage when a first piston acting within said first combustion chamber is located near an end of its compression stroke, and thereby charging said transfer passage with high pressure air independently of said intake system and said exhaust system; and opening a second communication between a second combustion chamber and said transfer passage when a second piston acting in said second combustion chamber is located near a start of its compression stroke.

17. The method of claim 16, further comprising the step of reopening said second communication near an end of a compression stroke of said second piston to thereby charge said transfer passage with high pressure air.

18. The method of claim 16, further comprising the step of closing said second communication and opening an exhaust valve of said second combustion chamber to place said second combustion chamber in communication with said exhaust system.

19. The method of claim 16, further comprising the step of opening an exhaust valve during an expansion stroke of a cylinder to limit engine braking retarding effect.

20. The method of claim 16, further comprising the step of closing an exhaust valve early in an expansion stroke of said first cylinder to increase expansion work.

* * * * *